US007667724B2

(12) United States Patent
May

(10) Patent No.: US 7,667,724 B2
(45) Date of Patent: Feb. 23, 2010

(54) CUSTOMER REPLACEABLE UNIT WITH HIGH VOLTAGE POWER SUPPLY

(75) Inventor: Jerome E. May, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 200 days.

(21) Appl. No.: 11/249,904

(22) Filed: Oct. 13, 2005

(65) Prior Publication Data

US 2007/0085879 A1 Apr. 19, 2007

(51) Int. Cl.
*B41J 2/47* (2006.01)

(52) U.S. Cl. ..... 347/228

(58) Field of Classification Search ..... 347/224, 347/114, 148, 159, 162, 228, 145; 399/110–125, 399/88, 25
See application file for complete search history.

(56) References Cited

U.S. PATENT DOCUMENTS

| | | | | |
|---|---|---|---|---|
| 3,985,436 | A | 10/1976 | Tanaka et al. | |
| 5,077,582 | A | 12/1991 | Krevette et al. | |
| 5,305,199 | A | 4/1994 | LoBiondo et al. | |
| 5,682,575 | A * | 10/1997 | Komori | 399/66 |
| 6,016,409 | A | 1/2000 | Beard et al. | |
| 6,023,593 | A | 2/2000 | Tomidokoro | |
| 6,173,128 | B1 | 1/2001 | Saber et al. | |
| 6,529,692 | B1 | 3/2003 | Haines et al. | |
| 6,798,997 | B1 | 9/2004 | Hayward et al. | |
| 2002/0076224 | A1 | 6/2002 | Pollocks | |
| 2002/0076225 | A1 * | 6/2002 | Kurz et al. | 399/12 |
| 2004/0156647 | A1 * | 8/2004 | Ishikawa et al. | 399/50 |
| 2005/0109829 | A1 * | 5/2005 | Postma | 235/375 |

FOREIGN PATENT DOCUMENTS

JP 2002287600 A * 10/2002

* cited by examiner

*Primary Examiner*—Hai C Pham
(74) *Attorney, Agent, or Firm*—Wiggin and Dana LLP

(57) ABSTRACT

A customer replaceable unit installable in a printing apparatus comprises a component requiring high voltage electric power for operation, a low voltage power input, and that cooperates with the low voltage power input in order to transform low voltage electric power from the low voltage power input into high voltage electric power for use by the component. The customer replaceable unit may also include a low voltage signal input, and the high voltage power supply unit controls output of the high voltage electric power in response to signals received at the low voltage signal input. The signals received at the low voltage signal input are independent of a type of the component in the customer replaceable unit, and the high voltage power supply unit provides an appropriate high voltage for the type of the component, thereby allowing modification of the type of component without having to provide a different low voltage signal.

21 Claims, 4 Drawing Sheets

CUSTOMER REPLACEABLE UNIT WITH HIGH VOLTAGE POWER SUPPLY

BACKGROUND

A common trend in machine design, particularly in the office equipment industry, is to organize a machine on a modular basis, wherein certain distinct subsystems of the machine are bundled together into modules which can be readily removed from the machine and replaced with new modules of the same or similar type. A modular design facilitates great flexibility in the business relationship with the customer. By providing subsystems in discrete modules, also known as "customer replaceable units" or CRUs, visits from a service representative can be made very short, since all the representative has to do is remove and replace a defective module. Actual repair of the module may take place remotely at the service provider's premises. Further, some customers may wish to have the ability to buy modules "off the shelf," such as from an equipment supply store. Indeed, it is possible that a customer may lease the machine and wish to buy a supply of modules as needed. Further, the use of modules, particularly for expendable supply units (e.g., copier and printer toner bottles) are conducive to recycling activities.

For example, U.S. Pat. No. 3,985,436 to Tanaka, et al., which is incorporated by reference herein in its entirety, describes an electrophotographic copying apparatus in which a photoreceptor, a developing device and a cleaning device for residual toner particles are integrally incorporated in a casing as one unit so as to be releasably inserted into the copying apparatus housing for efficient replacement and maintenance of such major components.

In order to facilitate a variety of business arrangements among manufacturers, service providers, and customers, it is known to provide these modules with electronically-readable memory devices, also known as "customer replaceable unit monitors" or CRUMs, which, when the module is installed in the machine, enable the machine to both read information from the CRUM and also write information to the CRUM. The information read from, or written to, the CRUM may be used by the machine to perform various functions. For example, U.S. Pat. No. 6,016,409 entitled "System For Managing User Modules in a Digital Printing Apparatus", which is incorporated by reference herein in its entirety, describes various data that may be stored in a CRUM and various functions that may be performed using this data.

Various components within the CRUs, such as charging corotrons, transfer corotrons, and the like, require high voltage electrical power for operation. Typically, printing apparatuses such as electrophotographic copiers and printers will employ a single, host-mounted high voltage power supply unit to generate this high voltage power, and will conduct this high voltage electrical power to the CRUs via various conductors and terminals, contacts, etc . . . One of the failure modes of such printing apparatuses is erratic behavior and print quality defects due to breakdown of the insulation around the conductors that carry the high voltage electrical power from the host-mounted high voltage power supply to the component within the CRU. The breakdown of the insulation is typically caused by the effects of plasma, which is always present around high voltage wires. The problems caused by the breakdown of insulation are erratic with difficult to describe symptoms and, as a result, are very difficult for trained service engineers to troubleshoot.

BRIEF SUMMARY

According to one aspect, there is provided a customer replaceable unit installable in a printing apparatus. The customer replaceable unit comprises a component requiring high voltage electric power for operation, a low voltage power input, and a high voltage power supply unit that cooperates with the low voltage power input in order to transform low voltage electric power from the low voltage power input into high voltage electric power for use by the component.

In another aspect, there is provided a printing apparatus comprising a low voltage power output disposed in the printing apparatus and a customer replaceable unit removable from the printing apparatus. The customer replaceable unit includes a component of the printing apparatus that requires high voltage electric power for operation. The customer replaceable unit also includes a low voltage power input and a high voltage power supply unit that cooperates with the low voltage power input in order to transform low voltage electric power from the low voltage power input into high voltage electric power for use by the component.

In yet another aspect, there is provided a method of refurbishing a customer replaceable unit for installation in a printing apparatus. The customer replaceable unit includes a high voltage power supply unit configured to transform low voltage electric power into high voltage electric power for use by a component of the customer replaceable unit. The power supply unit includes at least one of a transformer, a rectifier, a filter, and a regulator, and the method comprises: replacing or repairing the component and the at least one of the transformer, rectifier, filter, and regulator in the customer replaceable unit prior to installation of the customer replaceable unit in the printing apparatus.

BRIEF DESCRIPTION OF THE DRAWING

Referring now to the figures, which are exemplary embodiments, wherein like items are numbered alike.

DETAILED DESCRIPTION

Figure 1:
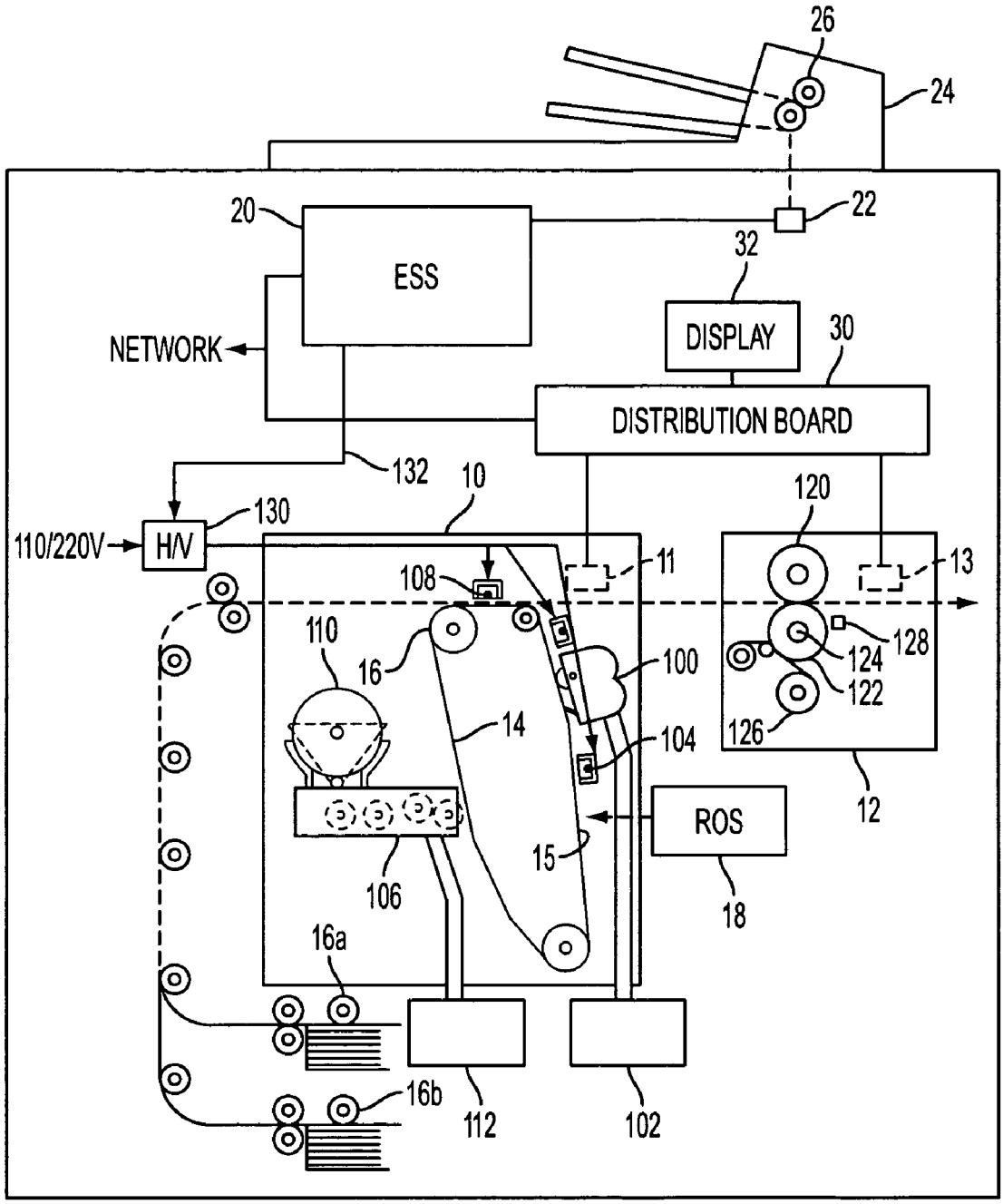
FIG. 1 PRIOR ART
FIG. 1 is a simplified, partially-elevational, partially-schematic view of a prior art electrophotographic printing apparatus.

FIG. 1 is a simplified partially-elevational, partially-schematic view of a prior art electrophotographic printing apparatus (printing apparatus) 9, in this case a combination digital copier/printer. As used herein, a "printing apparatus" can apply to any machine that outputs prints in whatever manner, such as a light-lens copier, digital printer, digital copier, bookmaking machine, facsimile machine, or multifunction device, and can create images electrostatographically, by ink-jet, hot-melt, or by any other method.

The printing apparatus 9 is organized on a modular basis, with certain distinct subsystems of the machine being bundled together into modules, also known as customer replaceable units or CRUs, which can be readily removed from the printing apparatus 9 and replaced with new modules of the same or similar type. For example, the printing apparatus 9 is shown to include two modules, a "xerographic module" indicated as 10, and a "fuser module" indicated as 12. While the xerographic module and fuser module are provided for purposes of example, it is contemplated that the modules may be any component, group of components, system, or subsystem of the printing apparatus 9. In general, it is contemplated that the printing apparatus 9 may include one or more customer replaceable modules, and it is expected that, at multiple times within the life of printing apparatus 9, one or more of these modules need to be removed or replaced. In the current market for office equipment, for example, it is typically desirable that modules such as 10 and 12 be readily replaceable by the end user, thus saving the expense of having a representative of the vendor visit the user.

As is familiar in the art of electrostatographic printing, there is contained within xerographic module 10 many of the essential hardware elements required to create desired images electrophotographically. The images are created on the surface of a rotating photoreceptor 14 which is mounted on a set of rollers 16, as shown. Disposed at various points around the circumference of photoreceptor 14 are a cleaning device generally indicated as 100, which empties into a "toner reclaim bottle" 102, and xerographic components such as a charging corotron 104, a developer unit 106, and a transfer corotron 108. As used herein, a "xerographic component" includes any electric device or electronic component, that operates to change a potential on a charge receptor such as photoreceptor 14. Xerographic components include for example, non-contact charging devices (e.g., corotrons, scorotrons, pin corotrons, dicorotrons, and other corona charging devices) and/or contact charging devices (e.g., charging rolls or aquatrons). Of course, in any particular embodiment of an electrophotographic printer, there may be variations on this general outline, such as additional corotrons, or cleaning devices, or, in the case of a color printer, multiple developer units.

With particular reference to developer unit 106, as is familiar in the art, the unit 106 generally comprises a housing in which a supply of developer (which typically contain toner particles plus carrier particles) which can be supplied to an electrostatic latent image created on the surface of photoreceptor 14 or other charge receptor. Developer unit 106 may be made integral with or separable from xerographic module 10; and in a color-capable embodiment, there would be provided multiple developer units 106, each unit developing the photoreceptor 14 with a different primary-color toner. A toner bottle 110, which could contain either pure toner or an admixture of carrier particles, continuously or selectably adds toner or developer into the main body of developer unit 106. In one particular embodiment of an electrophotographic printer, there is further supplied a developer receptacle here indicated as 112, which accepts excess developer directly from the housing of development unit 106. In this particular embodiment, the developer receptacle 112 should be distinguished from the toner reclaim bottle 102, which reclaims untransferred toner from cleaning device 100. Thus, in the illustrated embodiment, there are two separate receptacles for used or excess developer and toner.

Turning to fuser module 12, there is included in the present embodiment all of the essential elements of a subsystem for fusing a toner image which has been electrostatically transferred to a sheet by the xerographic module 10. As such, the fuser module 12 includes a pressure roll 120, a heat roll 122 including, at the core thereof, a heat element 124, and a web supply 126, which provides a release agent to the outer surface of heat roll 122 so that paper passing between heat roll 122 and pressure roll 120 does not stick to the heat roll 122. For purposes of the claims herein, either a heat roll or a pressure roll can be considered a "fuser roll." Also typically included in a fusing subsystem is a thermistor such as 128 for monitoring the temperature of a relevant portion of the subsystem.

Paper or other medium on which images are desired to be printed are retained on one or more paper stacks. Paper is drawn from the stacks, typically one sheet at a time, by feed rolls such as indicated as 16*a* and 16*b*. When it is desired to print an image on a sheet, a motor (not shown) activates one of the feed rolls 16*a*, 16*b*, depending on what type of sheet is desired, and the drawn sheet is taken from the stack and moved through a paper path, shown by the dot-dash line in FIG. 1, where it eventually comes into contact with the photoreceptor 14 within xerographic module 10. At the transfer corotron 108, the sheet receives an unfused image, as is known in the art. The sheet then passes further along the paper path through a nip formed between pressure roll 120 and heat roll 124. The fuser subsystem thus causes the toner image to be permanently fixed to the sheet, as is known in the art.

In a digital printing apparatus, whether in the form of a digital printer or in a digital copier, images are created by selectably discharging pixel-sized areas on the surface of photoreceptor 14, immediately after the surface is generally charged such as by corotron 104. Typically, this selective discharging is performed by a raster output scanner (ROS) indicated as 18, which, as is known, includes a modulating laser which reflects a beam off a rotating reflective polygon. Other apparatus for imagewise discharging of the photoreceptor 14, such as an LED bar or ionographic head, are also known. The image data operative of the ROS 18 or other apparatus typically generated by what is here called an "electronic subsystem" or ESS, here indicated as 20. (For clarity, the necessary connection between ESS 20 and ROS 18 is not shown.)

The ESS 20 can receive original image data either from a personal computer, or one of several personal computers or other apparatus on a network, or, in the case where the apparatus is being used as a digital copier, via a photosensor bar here indicated as 22. Briefly, the photosensor bar 22 typically includes a linear array of pixel-sized photosensors, on which a sequence of small areas on an original hard-copy image are focused. The photosensors in the array convert the dark and light reflected areas of the original image into electrical signals, which can be compiled and retained by ESS 20, ultimately for reproduction through ROS 18.

If the apparatus is being used in digital copier mode, it is typically desired to supply an original document handler, here generally indicated as 24, to present either or both sides of a sequence of hard-copy original pages to the photosensor bar 22. As is familiarly known, a document handler such as 24 may include any number of rollers, nudgers, etc. one of which is here indicated as 26.

There is further provided within an electrophotographic printing/copying apparatus, what is here called a "distribution board" 30. The distribution board 30 can send or receive messages, as will be described below, through the same network channels as ESS 20, or alternately through a telephone or facsimile line (not shown); alternately, the distribution board 30 can cause messages to be displayed through a display 32, typically in the form of a touch screen disposed on the exterior of the apparatus.

Distribution board 30 typically interacts with specially-adapted memory devices, here called "customer replaceable unit monitors," or CRUMs, which are associated with one or more customer-replaceable units (modules) within the apparatus. In the illustrated embodiment, xerographic module 10 and fuser module 12 are each designed to be customer-replaceable; such that the entire module 10 or 12 is simply removed in its entirety from the apparatus 9, and can then be immediately replaced by another module of the same or similar type. As is familiar in the copier or printer industry, consumers can buy or lease individual modules as needed, and typically replace the modules without any special training. As illustrated, the xerographic module 10 has associated therewith a CRUM 11, while the fuser module 12 has associated therewith a CRUM 13. In a particular embodiment, the xerographic module 10 may further have associated therewith the toner reclaim bottle 102 and the developer receptacle 112, both of which are separable units.

The overall purpose of each CRUMs 11 and 13 is to retain information for the particular module about how that module is being used within a machine. Each CRUM 11 or 13 can be considered a small "notepad" on which certain key data is entered and retained, and also periodically updated. Thus, if a particular module 10 or 12 is removed from an apparatus 9, the information will stay with the module. By reading the data that is retained within a CRUM at a particular time, certain use characteristics of the CRUM can be discovered. While the modules 10 and 12 are shown to include CRUMs, it will be appreciated that the modules may be used without CRUMs.

The CRUM 11 or 13 may be in the form of an EEPROM (electrically erasable programmable read only memory). Each CRUM 11, 13 may be connected to distribution board 30 using a wired architecture (e.g., a two-wire serial bus architecture) or wireless architecture (e.g., an infrared or radio frequency signal architecture). The non-volatile memory within the CRUM may be designed for special applications requiring data storage in a ROM, PROM, and EEPROM mode. Each CRUM such as 11 or 13 can serve as both a transmitter and receiver in the transfer of data with distribution board 30. U.S. Pat. No. 6,016,409 entitled "System For Managing User Modules in a Digital Printing Apparatus", which is incorporated by reference herein in its entirety, describes various data that may be stored in a CRUM and various functions that may be performed using this data.

In machines such as, for example, the printing apparatus 9, various components of modules within the machine (e.g., modules 10 and/or 12) require high voltage electrical power for operation. Such components may include, for example, xerographic components such as the charging corotron 104, developer unit 106, and transfer corotron 108. As used herein, "high voltage" is any voltage greater than or equal to 300 volts, as measured from line to ground. The high voltage may be alternating current (AC) or direct current (DC), depending on the requirements of the devices within the module 10. For AC voltage, the 300 volt value represents RMS (root-mean-square) voltage.

Because the high voltage required by these components is greater than the supply voltage available at most outlets, which is typically 110 to 220 volts, the printing apparatus 9 includes a high voltage power supply unit 130, which transforms the relatively low supply voltage to the high voltage used by the components. The high voltage power supply unit 130 may also receive control signals 132, which may be applied by control logic in the high voltage power supply unit 130 to regulate various parameters (e.g., timing, amplitude, voltage level, and the like) of the power output from the high voltage power supply unit 130. In addition to regulating the power supply, the high voltage power supply unit 130 may also rectify, filter, and otherwise condition the supply voltage to meet the power requirements of those components that require high voltage.

While not depicted, the printing apparatus 9 may also include a low voltage power supply unit, which transforms and/or otherwise conditions the 110/220 volt supply power into low voltage electrical power useable by the various components in the printing apparatus 9. As used herein, "low voltage" is any voltage less than 300 volts, as measured from line to ground. For AC voltage, this represents RMS (root-mean-square) voltage.

Figure 2:
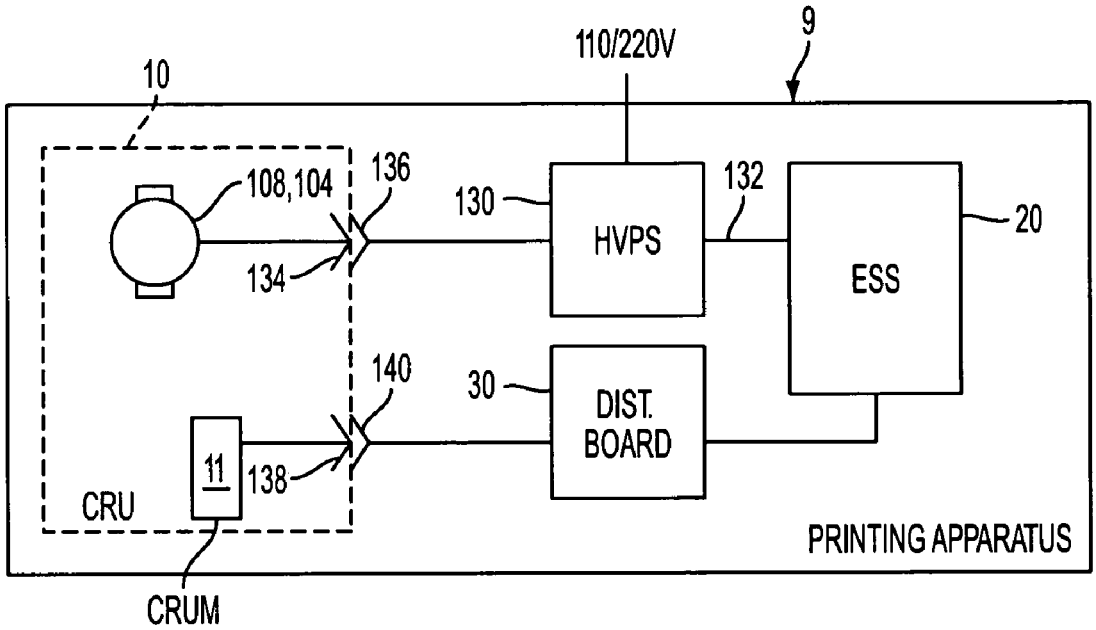
FIG. 2 PRIOR ART
FIG. 2 is a schematic depiction of an electrical connection between the electrophotographic printing apparatus and a customer replaceable unit in accordance with the prior art.

FIG. 2 is a single-line, schematic depiction of the electrical connection between the printing apparatus 9 and customer replaceable unit 10 in accordance with the prior art. As can be seen in FIG. 2, electrical connection between the high voltage power supply unit 130 and the components (e.g., 108 or 104) in the CRU 10 is made by way of a high voltage input 134 (electrical contacts, terminals, or the like) attached to the CRU 10, which mate with a high voltage output 136 (electrical contacts, terminals, or the like) attached to the printing apparatus 9. The high voltage input 134 and high voltage output 136 can be separated to allow the removal of the CRU 10 from the printing apparatus 9. In addition, a low voltage input 138 and a low voltage output 140 provide a low voltage electrical connection between the CRUM 11 and the distribution board 30. Although not shown, additional connections may be provided for low voltage power input to the CRU 10, as may be needed for various components within the CRU 10. While FIG. 2 depicts each input/output connection as a single conductor/terminal, it will be appreciated that each input/output connection is typically made through multiple conductors and terminals.

As previously noted, one of the failure modes of electrophotographic copiers and printers is erratic behavior and print quality defects due to breakdown of the insulation around conductors that carry high voltage electrical power from the host-mounted high voltage power supply unit 130 to the components within the CRU 10. As systems age, machine components subject to high voltage are subject to degradation due to the effects of plasma which is generated in areas of either high electric field (>0.1 kV/mm) or electric field gradient. Most frequently, it is insulation around wires that fails. In copiers and printers, the degradation of high voltage cables can give rise to electrical breakdown, particularly under conditions of high humidity, and the system behaviors when subject to the electrical noise of these high voltage arcs is quite unpredictable. As a consequence, such faults are difficult to diagnose even by highly trained service personnel, and frequently can require several return service events, or alternately, expensive shotgun replacement of all high voltage components if the specific faulty component cannot readily be identified.

Figure 3:
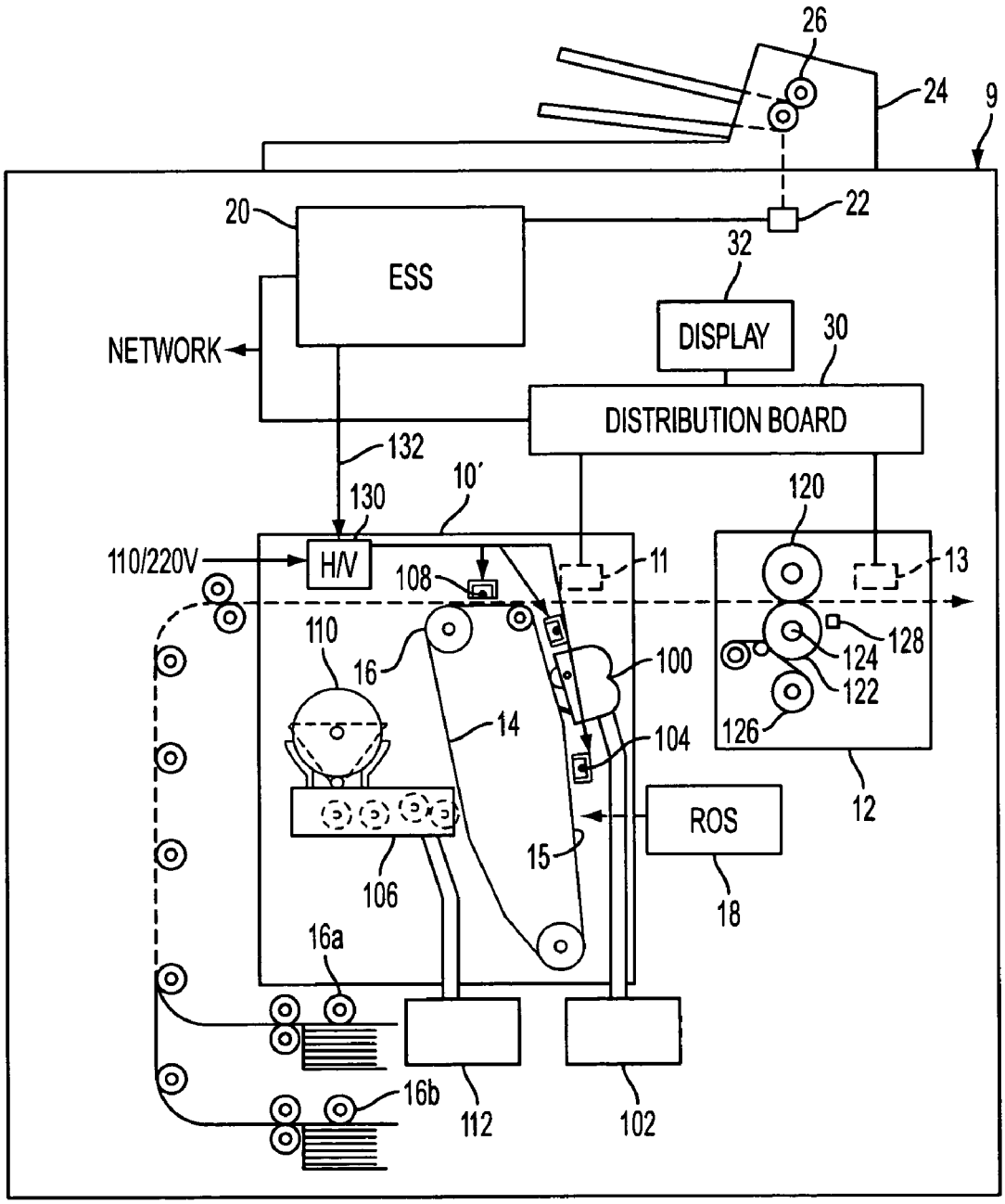
FIG. 3 is a simplified, partially-elevational, partially-schematic view of an electrophotographic printing apparatus having a high voltage power supply unit included in a customer replaceable unit.

Referring now to FIG. 3, a simplified, partially-elevational, partially-schematic view of an electrophotographic printing apparatus 9 having a high voltage power supply unit 130 included in a customer replaceable unit 10'. The high voltage power supply unit 130 forms part of the module 10, such that the when the module 10 is removed, so too is the high voltage power supply unit 130. While only one high voltage power supply unit 130 is shown, it is contemplated that each module 10' and 12 may include one or more high voltage power supply unit 130. It is contemplated that the module 10' performs the same functions as those described above with respect to the module 10. Furthermore, while the machine is depicted as a printing apparatus 9, it is contemplated that a module including the high voltage power supply unit 130 may be used in different types of machines.

Figure 4:
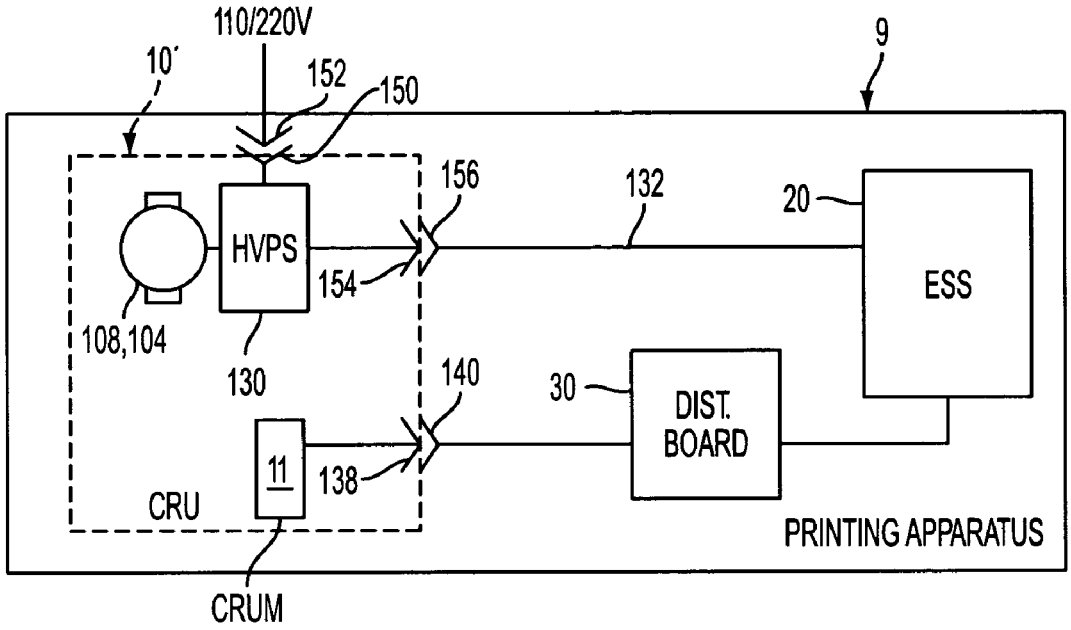
FIG. 4 is a schematic depiction of an electrical connection between the electrophotographic printing apparatus and the customer replaceable unit of FIG. 3.

FIG. 4 is a single-line, schematic depiction of the electrical connection between the printing apparatus 9 and the customer replaceable unit 10' of FIG. 3. Advantageously, each electrical connection between the CRU 10' and the host printing apparatus 9 is made by way of low voltage connections. Attached to the CRU 10' are low voltage inputs (terminals, contacts, and the like) 150, 154 and 138, which mate with corresponding low voltage outputs (terminals, contacts, and the like) 152, 156 and 140 attached to the printing apparatus 9. While FIG. 4 depicts each connection as a single conductor/terminal, it will be appreciated that each connection may be made through multiple conductors and terminals, as needed.

With the CRU 10' installed in the printing apparatus 9: low voltage input 150 connects with low voltage output 152 to provide electrical connection between the high voltage power supply unit 130 and the external, low voltage (e.g., 110/220) power source; low voltage input 154 connects with low voltage output 156 to provide electrical connection between the high voltage power supply and the ESS 20; and low voltage input 138 connects with low voltage output 140 to provide electrical connection between the distribution board 30 and the CRUM 11. Each of these input/output pairs can be separated to allow the removal of the CRU 10' from the printing apparatus 9. Low voltage outputs 152, 156, and 140 are secured to, and remain with the host printing apparatus 9 when the CRU 10' is removed from the printing apparatus 9. Similarly, low voltage inputs 150, 154, and 138 are secured to, and remain with the CRU 10' when it is removed from the printing apparatus 9.

By placing the high voltage power supply unit 130 within the CRU 10', and thus near the point of use, power losses and reliability risks associated with transmitting high voltage throughout the host printing apparatus 9 are reduced, and the cost of high voltage terminals necessary to communicate high voltage to the CRU 10' are eliminated. More specifically, by placing the high voltage power supply unit 130 near the one or more components within the CRU 10' , the unreliable and expensive high voltage inputs/outputs 134, 136 (FIG. 2) and conductors necessary to conduct high voltage electrical power between the host-mounted high voltage power supply 150 and the CRU 10, as shown in FIGS. 1 and 2, can be eliminated.

It is contemplated that the high voltage power supply unit 130 may include those high voltage generation components that are vulnerable to degradation due to plasma. Thus, the 'vulnerable' high voltage components would all be replaced whenever the CRU 10' is replaced by the customer or service engineer, and the high voltage components could then be inspected and tested, and either renewed or replaced at a refurbishing facility on a regular basis. Since xerographic CRUs have evolved from the realm of a few hours of operation to potentially hundreds of hours of operation, a time constant comparable to the electrical lifetime of insulators under high electric field stress, it becomes feasible to include the high voltage supply unit 130 as part of the periodically replaced CRU 10'. Furthermore, it will be appreciated that removal of the CRU 10' from the printing apparatus could be used by service personnel as an interlock to eliminate the possibility of high voltage exposure when the service personnel work on the remaining parts of the printing apparatus 9. The CRU cannot generate high voltage because it is physically disconnected from the low voltage energizing power supplies and, in some embodiments, does not receive any control signals.

Figure 5:
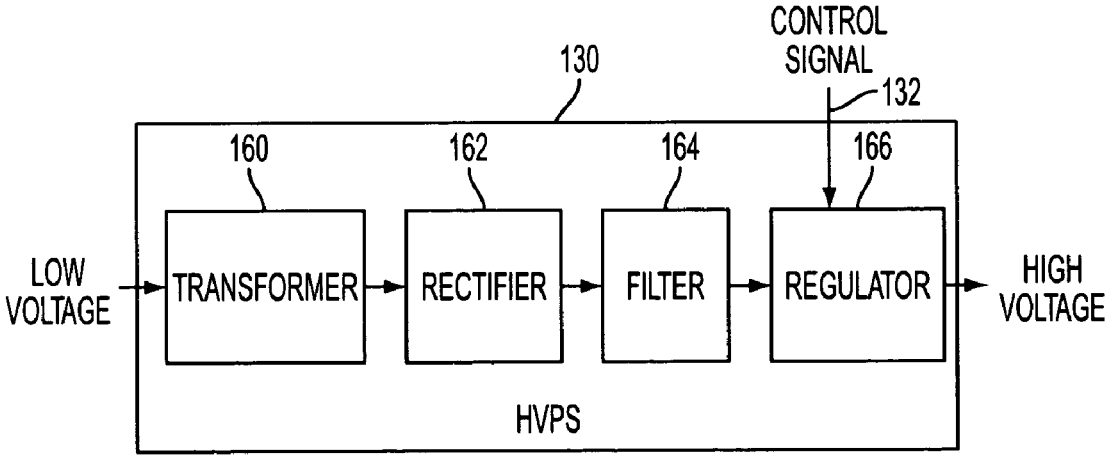
FIG. 5 is a functional block diagram of the high voltage power supply unit.

For example, FIG. 5 depicts a functional block diagram of those components of a high voltage power supply unit 130 that may be included in the CRU 10'. In the example of FIG. 5, the high voltage power supply unit 130 includes a transformer 160, which transforms the relatively low supply voltage (e.g., 110/220 volts) to the high voltage used by the components in the CRU 10'. The high voltage power supply unit 130 may also include various devices for conditioning the high voltage power. For example, the high voltage power supply unit 130 may include a rectifier 162 and filter 164, which rectify and filter the high voltage power, respectively. The high voltage power supply unit 130 may also include a regulator 166, which receives control signals 132 from the ESS 20, and regulates various parameters (e.g., timing, amplitude, voltage level, and the like) of the power output from the high voltage power supply unit 130.

The high voltage power supply unit 130 of FIG. 5 is shown for purposes of example only, and it will be appreciated that other functions may be performed by the high voltage power supply unit 130. Furthermore, it will be appreciated that the high voltage power supply unit 130 may be implemented in any manner to transform low voltage power to high voltage power and, optionally, to condition (e.g., rectify, filter, and/or regulate) the high voltage power.

With the high voltage power supply unit 130 included in the CRU 10', it is possible to provide a set of standard interface commands for use by the ESS 20 (FIG. 4) in controlling the power supply unit 130, while at the same time "hiding" the details of operation of the high voltage power supply unit 130 from the ESS 20. In other words, the signal 132 input to the power supply from the ESS 20 is independent of the type of components and/or power supply unit 130 in the CRU 10'. The host printing apparatus 9 sees the CRU 10' as a "black box" with known input signals 132, and the high voltage power supply unit 130 provides an appropriate high voltage power in response to the input signals 132. This encapsulation of the power supply for the CRU 10' allows for modification of the components within the CRU 10' without having to alter the signal 132 provided by the ESS 20.

For example, the charge corotron 104, the development unit 106, and transfer corotron 108, along with any other electrical component within the module 10, may each need to be biased to a very specific potential in order for the printing apparatus 9 to operate optimally. In a prior art apparatus, such as that depicted in FIG. 1, the ESS 20 must know the power supply requirements for the type of component used so that this potential can be achieved. For instance, the ESS 20 must know not only that the required potential needs to be about 650 volts but that the unit within the CRU 10 that does the charging is a two wire scorotron, and that to achieve the setpoint the wire potential must be about 6530 v and the potential applied to the scorotron control screen must be about 670 v. Any change in CRU technology (a different charge device, for example) would require that the host printing apparatus 9 be fitted with a new high voltage power supply unit 130 and/or be reprogrammed with a new control algorithm.

With the embodiment of FIGS. 3-5, the ESS 20 need only provide the high voltage power supply unit 130 with a signal 123 indicating the desired output. A controller associated with the high voltage power supply unit 130 (e.g., a microprocessor associated with the regulator 166), then determines the appropriate power for the various components of the CRU 10'. Using the example described above, the signal 132 provided by the ESS 130 may indicate a desired drum potential of about 650 volts and, if the CRU 10' contains a two wire scorotron as the xerographic component, then the high voltage power supply unit 130 generates the 6530 volt wire potential and the 670 v screen potential in response to this input signal; alternatively, if the CRU 10' contains a charging roll as the xerographic component, then the high voltage power supply unit 130 generates the appropriate DC and AC waveform to supply to the charging roll in order to achieve the 650 volt potential. In sum, the host printing apparatus 9 does not require intimate knowledge of the implementation of the subsystem technology in the CRU 10', allowing changes to be made to the CRU 10' without having to modify the host printing apparatus 9, as long as the functionality and external interfaces (e.g., signals 132) to the CRU 10' remains unchanged.

For example, in markets where extremely low ozone generation is required, a "low ozone" version of the CRU 10' (e.g., using a low ozone charging role) can be sold and incorporated into the same printing apparatus 9 as the standard office version of the CRU 10' (containing, for example, a corotron or scorotron charger). This advantage allows process improvements, such as xerographic process set point changes driven by improvements to internal components, to flow to the customer by means of the consumables chain (CRUs) rather than requiring a service person to visit the printing apparatus and manually change the high voltage power supply unit 130 or reprogram the host printing apparatus 9. It will be appreciated that one of the impediments to lower cost supplies for mature printer/copier products is the fact that the less expensive methods are sufficiently different from the older, more expensive methods, that the host engine needs a software change to take advantage of the difference. This software change is frequently an expensive undertaking, for the creation of the new software, distribution of the software to the installed fleet, and interoperability of a particular host engine with more than one "type" of supply item (CRU) available. Encapsulating the power supply in the CRU 10' allows for modification of the components within the CRU 10' without having to alter the signal 132 provided by the ESS 20, thus allowing the newer, improved, and/or less expensive methods to be implemented in the host printing apparatus 9 without having to modify the host printing apparatus 9.

It should be understood that any of the features, characteristics, alternatives or modifications described regarding a particular embodiment herein may also be applied, used, or incorporated with any other embodiment described herein.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A customer replaceable unit installable in a printing apparatus, the customer replaceable unit comprising:

a component requiring high voltage electric power for operation;

a low voltage power input;

a high voltage power supply unit that cooperates with the low voltage power input in order to transform low voltage electric power from the low voltage power input into high voltage electric power for use by the component, the high voltage power supply unit including a controller; and a low voltage signal input, separate from the low voltage power input, wherein the high voltage power supply unit controls output of the high voltage electric power in response to signals received at the low voltage signal input, the signals received at the low voltage signal input comprise a set of interface commands independent of a type of the component and independent of a type of the high voltage power supply unit, the signals received at the low voltage signal input indicate a desired output of the high voltage power supply unit, and the controller determines a power level for operating the component in accordance with the desired output.

2. The customer replaceable unit of claim 1, wherein the high voltage power supply unit conditions the high voltage electric power.

3. The customer replaceable unit of claim 1, wherein the high voltage power supply unit provides an appropriate high voltage for the type of the component, thereby allowing modification of the type of component without having to alter the voltage signal.

4. The customer replaceable unit of claim 3, wherein the component includes a xerographic component.

5. The customer replaceable unit of claim 1, wherein the component comprises part of an electrostatographic printing apparatus.

6. The customer replaceable unit of claim 1, further comprising:

a customer replaceable unit monitor having information stored therein relating to operation of the high voltage power supply unit.

7. The customer replaceable unit of claim 1, wherein the high voltage power supply unit is effective in providing a high voltage greater than or equal to 300 volts.

8. A printing apparatus comprising:

a low voltage power output disposed in the printing apparatus; and a customer replaceable unit removable from the printing apparatus, the customer replaceable unit including:

a component of the printing apparatus that requires high voltage electric power for operation:

a low voltage power input;

a high voltage power supply unit that cooperates with the low voltage power input in order to transform low voltage electric power from the low voltage power input into high voltage electric power for use by the component, the high voltage power supply unit including a controller; and a low voltage signal input, separate from the low voltage power input, wherein the high voltage power supply controls output of the high voltage electric power in response to signals received at the low voltage signal input, the signals received at the low voltage signal input comprise a set of interface commands independent of a type of the component and independent of a type of the high voltage power supply unit, the signals received at the low voltage signal input indicate a desired output of the high voltage power supply unit, and the controller determines a power level for operating the component in accordance with the desired output.

9. The printing apparatus of claim 8, wherein the high voltage power supply unit conditions the high voltage electric power.

10. The printing apparatus of claim 8, wherein the high voltage power supply unit is effective to provide a high voltage greater than or equal to 300 volts.

11. The printing apparatus of claim 10, wherein the high voltage power supply unit provides an appropriate high voltage for the type of the component, thereby allowing modification of the type of component without having to provide a different low voltage signal.

12. The printing apparatus of claim 8, wherein the component is a component of an electrostatographic printing apparatus.

13. The printing apparatus of claim 12, wherein the component includes a xerographic component.

14. The printing apparatus of claim 8, further comprising:

a customer replaceable unit monitor attached to the customer replaceable unit, the customer replaceable unit monitor having information stored therein relating to operation of the high voltage power supply unit.

15. A customer replaceable unit installable in a machine, the customer replaceable unit comprising:

a component requiring high voltage electric power for operation;

a low voltage power input;

a high voltage power supply unit that cooperates with the low voltage power input in order to transform low voltage electric power from the low voltage power input into high voltage electric power for use by the component, the high voltage power supply unit including a controller; and a low voltage signal input, separate from the low voltage power input, wherein the high voltage power supply unit controls output of the high voltage electric power in response to signals received at the low voltage signal input, the high voltage power supply unit is effective in providing a high voltage greater than or equal to 300 volts, the signals received at the low voltage signal input are independent of a type of the component and independent of a type of the high voltage power supply unit, the signals received at the low voltage signal input indicate a desired output of the high voltage power supply unit, and the controller determines a power level for operating the component in accordance with the desired output.

16. The customer replaceable unit of claim 15, wherein the high voltage power supply unit conditions the high voltage electric power.

17. The customer replaceable unit of claim 15, wherein the high voltage power supply unit provides an appropriate high voltage for the type of the component, thereby allowing modification of the type of component without having to alter the voltage signal.

18. The customer replaceable unit of claim 17, wherein the component includes a xerographic component.

19. The customer replaceable unit of claim 15, wherein the component comprises part of a printing apparatus.

20. The customer replaceable unit of claim 15, further comprising:

a customer replaceable unit monitor having information stored therein relating to operation of the high voltage power supply unit.

21. A customer replaceable unit installable in a printing apparatus, the customer replaceable unit comprising:

a component requiring high voltage electric power for operation;

a low voltage power input;

a low voltage signal input, separate from the low voltage power input, that provides signals comprising a set of interface commands independent of a type of the component and independent of a type of the high voltage power supply unit; and a high voltage power supply unit including a controller that controls the output of the high voltage electric power in response to signals received at the low voltage signal input and is effective to provide an appropriate high voltage power greater than or equal to 300 volts for use by the component, thereby allowing modification of the type of component without having to alter the voltage signal, the high voltage power supply unit further capable of conditioning the high voltage electric power, wherein the signals received at the low voltage signal input indicate a desired output of the high voltage power supply unit, and the controller determines a power level for operating the component in accordance with the desired output.

* * * * *